United States Patent [19]

Hashimoto

[11] Patent Number: 4,849,740

[45] Date of Patent: Jul. 18, 1989

[54] SAFETY DEVICE FOR A SHEET CUTTER APPARATUS

[75] Inventor: Kazuo Hashimoto, Tokyo, Japan

[73] Assignee: Hashimoto Corporation, Tokyo, Japan

[21] Appl. No.: 220,701

[22] Filed: Jul. 15, 1988

[30] Foreign Application Priority Data

Jul. 17, 1987 [JP] Japan ..... 62-178437

[51] Int. Cl.[4] ..... G08B 21/00

[52] U.S. Cl. ..... 340/679; 340/530; 340/540; 340/686

[58] Field of Search ..... 340/679, 686, 530, 529, 340/540

[56] References Cited

U.S. PATENT DOCUMENTS 3,797,006 3/1974 Reininger ..... 340/530

4,707,684 11/1987 Janke et al. ..... 340/530

*Primary Examiner*—Glen R. Swann, III

*Attorney, Agent, or Firm*—Lowe, Price, LeBlanc, Becker & Shur

[57] ABSTRACT

A sheet cutter apparatus includes circuitry for detecting when the blades of the cutter are in an "open" position with their cutting edges separted from each other, and a timer that is initiated when the blades are first opened. If the blades remain open for an excessive period of time, determined by the timer, a warning alarm is generated to remind personnel to close the blades, so that no injuries to fingers, etc., will occur.

6 Claims, 1 Drawing Sheet

SAFETY DEVICE FOR A SHEET CUTTER APPARATUS

BACKGROUND OF INVENTION

The present invention relates to a sheet cutter apparatus for cutting paper or plastic, and more particularly to a safety device for a sheet cutter apparatus.

In a conventional sheet cutter apparatus for cutting paper or plastic, paper or plastic is cut by pushing a second, movable cutting edge toward a first, fixed cutting edge mounted on a stand.

In a conventional sheet cutter apparatus having the above structure, when an operator does not use the sheet cutter apparatus, the operator sometimes forgets to lock the second cutting edge to a "closed" position. In an "open" position with the first and second cutting edges separated from each other, a finger can be pinched between the first cutting edge and the second cutting edge by playing a prank, etc. As a result, the finger is in danger of getting hurt by being cut by the first cutting edge and/or the second cutting edge.

SUMMARY OF THE INVENTION

It is an object of the present invention to draw an operator's attention by a warning which occurs after a specific time following placing of the apparatus in its "open" position with the first cutting edge and the second cutting edge separated from each other.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

The detailed description of the preferred embodiments according to the present invention will be now described with reference to accompanying drawings.

Figure 1:
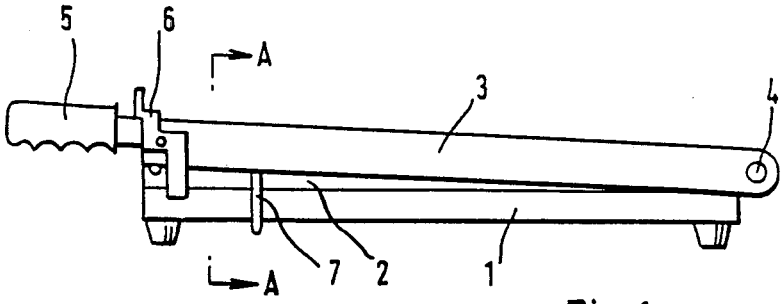
FIG. 1 is a side view of the sheet cutter apparatus.

FIG. 1 shows a side view of a conventional sheet cutter apparatus. Reference numeral 1 denotes a stand, reference numeral 2 denotes the first cutting edge fixed in position on the stand, reference numeral 3 denotes the second cutting edge that is movable relative to the first cutting edge for cutting a sheet positioned therebetween, reference numeral 4 denotes a pivot which holds movably the second cutting edge, reference numeral 5 denotes a handle of the second cutting edge, reference numeral 6 denotes a catch which locks the second cutting edge to the first cutting edge, and reference numeral 7 denotes a switch operator which is necessary on this invention.

Figure 2:
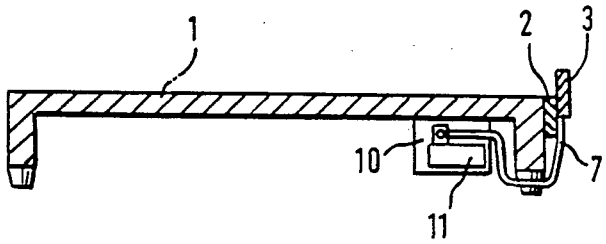
FIG. 2 is a sectional view taken along line A—A of the sheet cutter apparatus in the FIG. 1.

FIG. 2 shows a sectional view taken along line A—A of FIG. 1, Reference numeral 10 denotes a printed circuit board, and reference numeral 11 denotes a micro switch.

Figure 3:
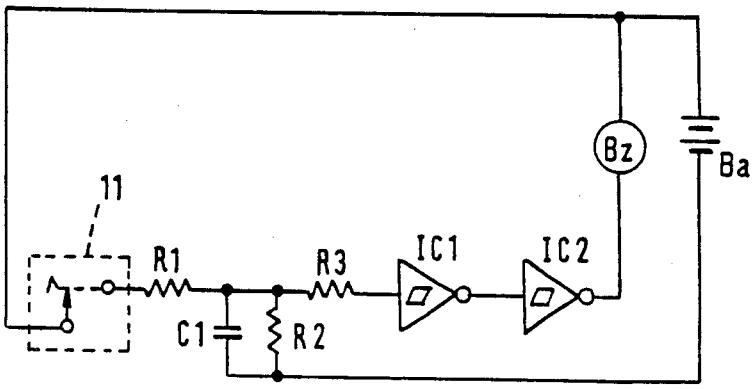
FIG. 3 is a circuit diagram of the preferred safety device for a sheet cutter apparatus.

FIG. 3 shows a circuit diagram of preferred embodiment.

As shown in FIG. 2, when the cutter apparatus is "closed", the second cutting edge 3 pushes against the switch operator 7, and the micro switch 11 is closed ("ON"). As a result, the input side of an inverter IC1 is kept at a high level by charging capacitor C1 from a battery Ba through a resistance R1. Since the output of inverter IC2 is at the high level, electric current is not applied through a buzzer Bz and the buzzer Bz is not operated.

When the handle 5 of the second cutting edge 3 is raised for cutting a sheet, the second cutting edge 3 separates from the switch operator 7. As a result, the micro switch opens ("OFF"), charging of the capacitor C1 from the battery Ba stops and electric charge in the capacitor C1 starts discharging through a resistance R2.

In this embodiment, time constant of the condenser C1 and resistor R2 is set to about 3 minutes. Accordingly, when a sheet, etc. is cut by the sheet cutter apparatus, and thereafter the sheet cutter apparatus returns to a "closed" position with the first and second cutting edges not separated from each other, within 3 minutes, the micro switch 11 being set by operator 7 to "ON", the capacitor C1 is charged quickly through the resistance R1 and there is no buzzer sound.

However, when the "open" position with the first cutting edge and the second cutting edge separated from each other, is maintained more than for 3 minutes, switch 11 being "OFF", all the electric charge in the capacitor C1 is discharged. As a result, the input of the inverter IC1 changes from high level to low level and also output from the inverter IC2 changes from high level to low level. Electric current is sent to the buzzer Bz and the buzzer is operated. When an operator who hears a sound from the buzzer Bz returns the apparatus to its "closed" position with the first and second cutting edges not separated from each other, the second cutting edge pushes the switch operator 7. The micro switch 11 is turned "ON", and the capacitor C1 is charged quickly. As a result, the sound from the buzzer stops immediately.

As explained above, when the second cutting edge of the sheet cutting apparatus maintains a dangerous "open" position for cutting a sheet for more than the specific time set previously, the buzzer is buzzed, and a warning accordingly is given around the sheet cutting apparatus in order to prompt the return of the second cutting edge to its "closed" position. As a result, an accident such as cutting of a finger, etc. by fall of the second cutting edge, including mischief by children, can be prevented.

Although certain preferred embodiments have been shown and described, it should be understood that many changes and modifications may be made therein without departing from the scope of the invention.

What is claimed is:

1. For a sheet cutter apparatus having a first cutting edge fixed in position on a stand and a second cutting edge that is movable relative to first cutting edge for cutting a sheet positioned therebetween, a safety device, comprising:

means for detecting that the cutter apparatus is in an "open" position with the first and second cutting edges separated from each other;

timer means for providing a predetermined time duration; and alarm means responsive to said detecting means and said timer means for generating an alarm when said cutter apparatus is "open" for a time duration greater than said predetermined time duration.

2. The device of claim 1, including means for turning off said alarm when said cutter apparatus is thereafter returned to a "closed" position with the first and second cutting edges not separated from each other.

3. The device of claim 2, wherein said detecting means includes a limit switch mounted to said stand in proximity to said second cutting edge and operated by said second cutting edge.

4. The device of claim 3, wherein said timer means includes a capacitor means, means coupled to a source of electricity and said limit switch for charging said capacitor means, and wherein said turning off means includes circuit means response to said limit switch for discharging said capacitor means.

5. The device of claim 4, wherein said limit switch means is open to allow discharge of said capacitor means and turn on said alarm means when said cutter apparatus is "open", and further wherein said circuit means includes means for charging said capacitor means to turn off said alarm means when said limit switch means is closed.

6. The device of claim 4, wherein said alarm means comprises an audible alarm and means for driving said audible alarm in response to said capacitor means.

* * * * *